United States Patent [19]

Mattox

[11] Patent Number: 5,054,726

[45] Date of Patent: Oct. 8, 1991

[54] COMMUNION CUP HOLDER

[76] Inventor: Robert T. Mattox, 11029 E. Weaver Ave., South El Monte, Calif. 91733

[21] Appl. No.: 589,398

[22] Filed: Sep. 26, 1990

[51] Int. Cl.[5] ..... A47G 1/17

[52] U.S. Cl. ..... 248/206.5; 248/311.2

[58] Field of Search ..... 248/206.5, 309.1, 311.2, 248/309.4, 313, 315, 314; 297/194, 411; 211/88, 75

[56] References Cited

U.S. PATENT DOCUMENTS

| | | | |
|---|---|---|---|
| D. 208,612 | 9/1967 | Heseley | 248/311.2 X |
| 1,355,750 | 10/1920 | Leibner | 248/315 X |
| 1,393,673 | 10/1921 | Dingee | 248/315 |
| 3,055,381 | 9/1962 | Zielinski | 248/206. 5 X |
| 3,314,635 | 4/1967 | Frye | 248/311.2 |
| 3,482,910 | 12/1969 | Debelius | 248/206.5 X |
| 3,945,596 | 3/1976 | Marraccini | 248/311.2 |
| 4,100,684 | 7/1978 | Berger | 248/206.5 X |
| 4,783,037 | 11/1988 | Flowerday | 297/194 X |
| 4,795,211 | 1/1989 | Stern | 297/411 X |
| 4,828,211 | 5/1989 | McConnell | 211/75 X |

FOREIGN PATENT DOCUMENTS

| | | | |
|---|---|---|---|
| 1078946 | 3/1960 | Fed. Rep. of Germany | 248/206.5 |
| 1421505 | 11/1965 | France | 248/206.5 |

*Primary Examiner*—J. Franklin Foss

*Attorney, Agent, or Firm*—Poms, Smith, Lande & Rose

[57] ABSTRACT

An apparatus for holding a communion cup has a means for attaching the apparatus to the metal leg of a chair, and a means for supporting the communion cup in an upright position. The attachment means comprises an angle support and a pair of magnetic blocks permanently adhered to the interior walls of the angle support. The supporting means comprises a ring tangentially affixed to an exterior wall of the angle support.

5 Claims, 2 Drawing Sheets

FIG. 1
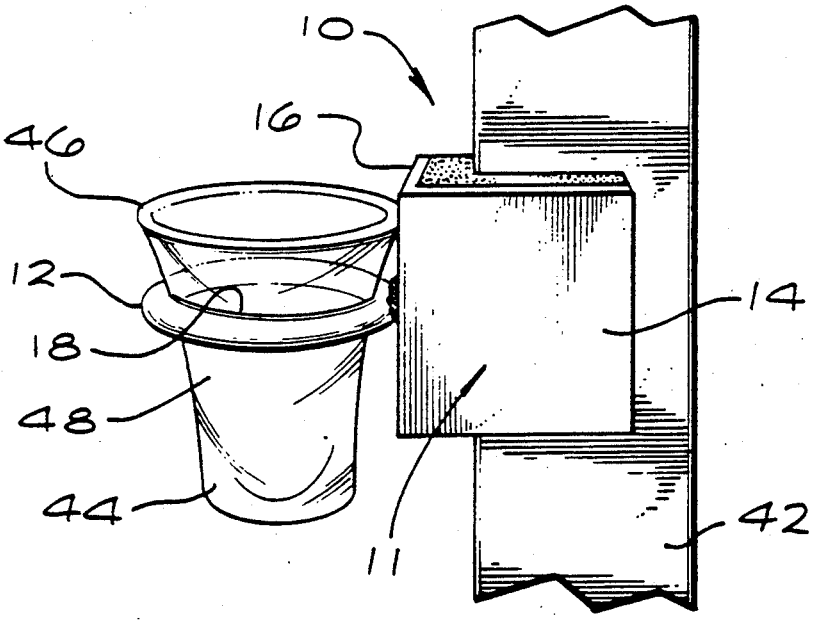
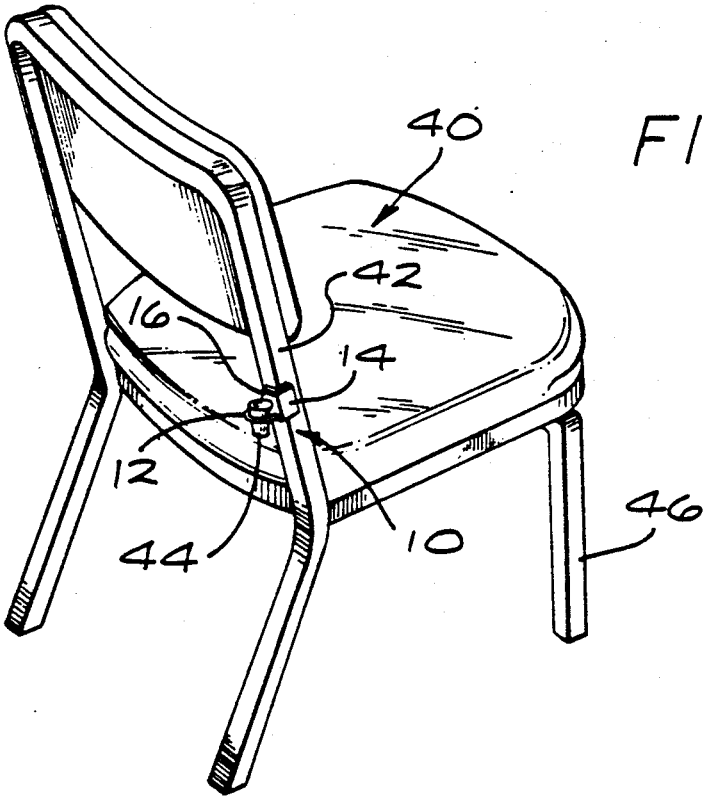
FIG. 2

COMMUNION CUP HOLDER

INTRODUCTION

Generally stated, the present invention relates to cup holders, and more particularly, to a novel apparatus for holding a communion cup.

BACKGROUND OF THE INVENTION

Attending religious services is an important aspect of life for many people. As part of the services, many religious denominations partake in the consumption of sacramental wine. This wine is often provided to the parishioners in a small communion cup. Depending on the type of religious denomination, the parishioner will either consume the wine at the alter, or it will be brought to his seat and consumed there in conjunction with prayers or songs.

A common problem that arises for many parishioners is the disposal or temporary placement of the communion cup. When the parishioner returns to his seat, he often finds that there is no convenient place to set the cup down while he adjusts his chair or turns the pages of a prayer book. This difficulty frequently results in the sacramental wine being spilled on the floors, seats and clothing. After the services, the disposable cups are often scattered about the floor and under the seats, which creates an eyesore for the parishioners and compounds the cleanup problems for the janitorial crew.

Therefore, it would be advantageous to provide an apparatus for holding a communion cup so as to prevent spills, to provide a temporary placement, and to aid in cleanup. It would also be desirable if such an apparatus could be simply attached to a metal stacking or folding chair, as commonly used in many churches. Additionally, it would also be desirable if the apparatus could be inexpensively made, so as to be within the limited budgets of most congregations.

SUMMARY OF THE INVENTION

It is therefore a primary object of the present invention to provide an apparatus for holding a communion cup. It is also an object of the present invention to provide such an apparatus that can simply attach to a metal stacking or folding chair. It is further an object to provide an apparatus that is inexpensive to manufacture.

Generally stated, the present invention includes the provision of an attachment means for attaching the apparatus to a metal leg of a chair, and a holding means for supporting a communion cup in an upright position. More specifically, the attachment means comprises an angle support and a pair of magnetic blocks permanently affixed to the interior walls of the angle support. The holding means comprises a ring tangentially attached to an exterior wall of the angle support. The apparatus can be manufactured of either metal or plastic material.

A more complete understanding of the invention will be afforded to those skilled in the art, as well as a realization of additional advantages and objects thereof, by a consideration of the following detailed description of a preferred exemplary embodiment. Reference will be made to the appended sheets of drawings which will first be described briefly.

DESCRIPTION OF THE DRAWINGS

FIG. 1 is a perspective view of an exemplary communion cup holder of present invention;

FIG. 2 is a second perspective view of an exemplary communion cup holder attached to a stacking chair;

DETAILED DESCRIPTION OF A PREFERRED EXEMPLARY EMBODIMENT

Referring first to FIGS. 1 and 2, a preferred exemplary embodiment of an apparatus for holding a communion cup in accordance with the present invention is illustrated. Simply stated, the exemplary communion cup holder 10 attaches to chair 40, and holds communion cup 44. As shown, the exemplary apparatus conveniently and unobtrusively provides a temporary resting place for the communion cup well within the parishioner's reach.

Figure 5:
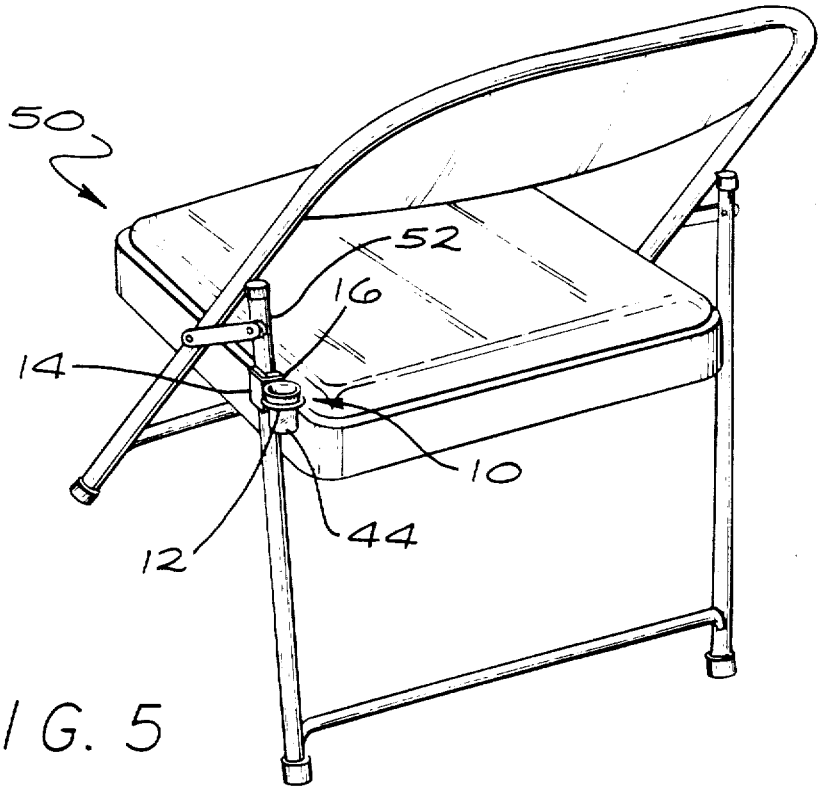
FIG. 5 is a third perspective view, as in FIG. 2, showing the exemplary communion cup holder attached to a folding chair.

It is common for most congregations to supply movable chairs to comfortably seat its members. Therefore, it is anticipated that the apparatus of the present invention be utilized in conjunction with a chair having metallic legs, the type of chairs most commonly used by such congregations. FIG. 2 exemplarily shows chair 40 as having legs constructed of square metal tubing, however it is also anticipated that the apparatus be usable with a chair having round metal legs, as shown in FIG. 5. It is further anticipated that the present apparatus operate with stacking chairs of the type shown in FIG. 2, as well as folding chairs or any other type of chair having metallic legs.

Congregations of numerous denominations often supply a communion cup constructed of paper, glass, plastic or other material. The typical communion cup is sized to hold only a few ounces of a prayer beverage, usually a sacramental wine. In the present invention, the exemplary communion cup 44 is generally conical in shape, having a mouth portion 46 and a circular side portion 48.

Figure 3:
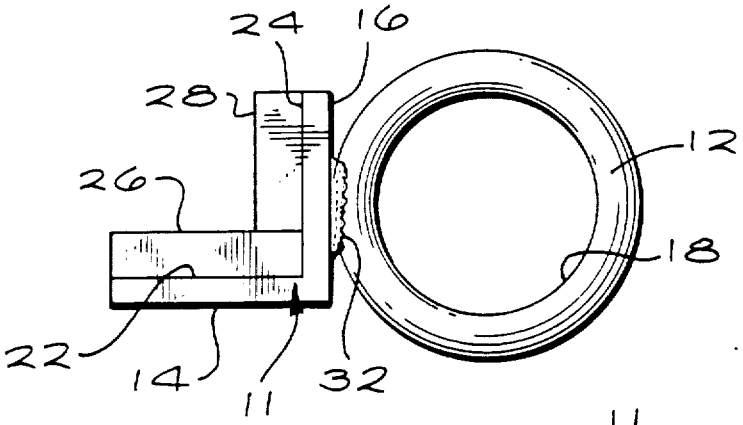
FIG. 3 is a top view of an exemplary communion cup holder.
Figure 4:
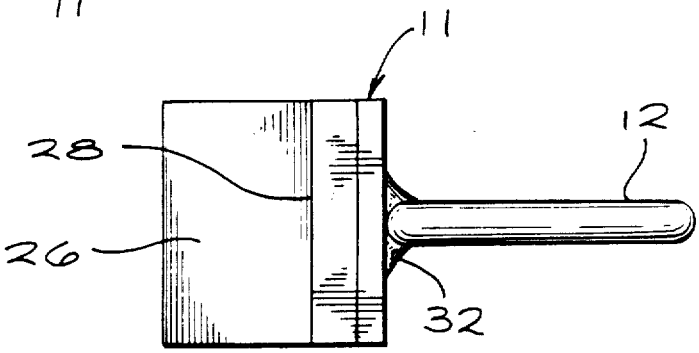
FIG. 4 is a side view of an exemplary communion cup holder.

Referring now to FIGS. 3 and 4, the exemplary communion cup holding apparatus 10 comprises a means for magnetically attaching the apparatus to leg 42, and a holding means for supporting cup 44 in an upright position. The attachment means has an angle support 11, and first and second magnetic blocks 26 and 28. Angle support 11 is formed of two rectangular plates which meet at a right angle along an edge, and has first and second interior walls 22 and 24, and first and second exterior walls 14 and 16. Magnetic blocks 26 and 28 are permanently attached to interior walls 22 and 24, respectively, by use of glue or other commonly known bonding technique. The combined interior walls 22 and 24 and magnetic blocks 26 and 28 face toward the surface of leg 42 when the apparatus is in place. The angle support 11 provides three dimensional structural integrity to the apparatus 10, and a surface for attachment of the supporting means, as will be described hereinbelow. The magnetic blocks 26 and 28 provide magnetic force which affixes the apparatus 10 to leg 42.

With the attaching means in place, as shown in FIG. 2, the exterior walls 14 and 16 are exposed, and form vertical planes parallel to two sides of the square metal leg 42. The magnetic force is selected to be powerful enough to keep the apparatus 10 from sliding or falling off the leg 42, while at the same time weak enough to be manually removable. Alternatively, round metal leg 52, as shown in FIG. 5, would contact the magnetic blocks 26 and 28 tangentially, also providing sufficient force to grip the leg.

The supporting means comprises ring 12 having inner surface 18. Ring 12 is exemplarily shown in FIG. 1 as round, however it is anticipated that the shape of ring 12 be commensurate with that of cup 44 so as to engage cup 44, as described hereinbelow. Ring 12 tangentially attaches to either exterior wall 14 or 16 such that ring 12 extends horizontally from the vertically mounted exterior wall. As shown in FIG. 1, cup 44 drops through ring 12 such that side portion 48 of cup 44 frictionally engages inner surface 18 of ring 12, holding cup 44 in an upright position with mouth portion 46 available just above ring 12.

It is anticipated that both angle support 11 and ring 12 be constructed of metal, and that ring 12 be welded to one of exterior walls 14 and 16. However, it is also contemplated that the angle support 11 and ring 12 be constructed of plastic, wherein ring 12 would attach by epoxy, by any other known bonding technique, or otherwise integrally formed.

To use the exemplary communion cup holder 10 in accordance with the present invention, the device is simply placed on the leg 42 of chair 40. Normally, the apparatus 10 would be attached to the rear leg 42 of a chair 40. This way, the apparatus would service the parishioner seated in the next row back. However, the apparatus can also be attached to the front leg 46, to service the parishioner seated on that chair. The apparatus provides a stable platform for the ring 12 of the holding means. A parishioner returning to his seat with a communion cup partially filled with sacramental wine can simply set the cup 44 in the ring 12. The cup 44 will steadily remain in place on the apparatus 10 until the parishioner chooses to remove it. Without having to hold the cup to prevent its spilling, the parishioner's hands are then freed to adjust his seat or turn the pages of a prayer book.

There has been described hereinabove a preferred exemplary embodiment of a novel apparatus for holding a communion cup. It is apparent that those skilled in the art may now make numerous uses of and departures from the above described embodiment without departing from the inventive concepts disclosed herein. Accordingly, the present invention is to be defined solely by the scope of the following claims.

I claim:

1. An apparatus for holding a cup, said apparatus being attachable to the metallic leg of a chair and comprising:

a means for magnetically attaching said apparatus to said chair leg, said attaching means comprising an angle support and a first and second magnetic block, said angle support having a first and second interior wall and a first and second exterior wall, each of said magnetic blocks being permanently affixed to a respective one of said interior walls; and a means for supporting said cup in an upright position, said supporting means comprising a ring, said ring being tangentially attached to said first exterior wall such that said ring extends horizontally from said magnetic attachment means, said cup frictionally engaging said ring.

2. The apparatus of claim 1 wherein said angle support and said ring are composed of metal, and said ring is welded to said first exterior wall.

3. The apparatus of claim 1 wherein said angle support and said ring are composed of plastic, and said ring is attached to said first exterior wall by use of epoxy.

4. An apparatus for holding a cup to a chair, said chair having at least one metal leg, said cup holding apparatus comprising:

an angle support having a first and second interior wall, and a first and second exterior wall;

a first and second magnetic block, each of said blocks being permanently affixed to a respective one of said interior walls;

a ring tangentially attached to said first exterior wall such that said ring extends horizontally from said first exterior wall; and said apparatus being removably mounted to said metal leg by placing each of said magnetic blocks in contact with surfaces of said metal leg.

5. The apparatus of claim 4 wherein said angle support and said ring are selected from a group comprising metal and plastic.

* * * * *

UNITED STATES PATENT AND TRADEMARK OFFICE

CERTIFICATE OF CORRECTION

PATENT NO. : 5,054,726

DATED : October 8, 1991

INVENTOR(S) : Robert T. Mattox

It is certified that error appears in the above-identified patent and that said Letters Patent is hereby corrected as shown below:

Title page, should be replaced with the attached title page.

The drawing sheet, consisting of Figs. 3, 4, and 5, should be added as shown on the attached page.

Signed and Sealed this

Thirteenth Day of July, 1993

*Attest:*

Michael K. Kirk

MICHAEL K. KIRK

*Attesting Officer*

*Acting Commissioner of Patents and Trademarks*

Jnited States Patent [19]
lattox

[11] Patent Number: 5,054,726
[45] Date of Patent: Oct. 8, 1991

4] COMMUNION CUP HOLDER

6] Inventor: Robert T. Mattox, 11029 E. Weaver Ave., South El Monte, Calif. 91733

1] Appl. No.: 589,398

2] Filed: Sep. 26, 1990

1] Int. Cl.[5] ..... A47G 1/17
2] U.S. Cl. ..... 248/206.5; 248/311.2
8] Field of Search ..... 248/206.5, 309.1, 311.2, 248/309.4, 313, 315, 314; 297/194, 411; 211/88, 75

6] References Cited

U.S. PATENT DOCUMENTS

| | | | |
|---|---|---|---|
| D. 208.612 | 9/1967 | Heseley | 248/311.2 X |
| 1.355.750 | 10/1920 | Leibner | 248/315 X |
| 1.393.673 | 10/1921 | Dingee | 248/315 |
| 3.055.381 | 9/1962 | Zielinski | 248/206. 5 X |
| 3.314.635 | 4/1967 | Frye | 248/311.2 |
| 3.482.910 | 12/1969 | Debelius | 248/206.5 X |
| 3.945.596 | 3/1976 | Marraccini | 248/311.2 |
| 4.100.684 | 7/1978 | Berger | 248/206.5 X |
| 4.783.037 | 11/1988 | Flowerday | 297/194 X |
| 4.795.211 | 1/1989 | Stern | 297/411 X |
| 4.828.211 | 5/1989 | McConnell | 211/75 X |

FOREIGN PATENT DOCUMENTS

| | | | |
|---|---|---|---|
| 1078946 | 3/1960 | Fed. Rep. of Germany | 248/206.5 |
| 1421505 | 11/1965 | France | 248/206.5 |

*Primary Examiner*—J. Franklin Foss
*Attorney, Agent, or Firm*—Poms, Smith, Lande & Rose

[57] ABSTRACT

An apparatus for holding a communion cup has a means for attaching the apparatus to the metal leg of a chair, and a means for supporting the communion cup in an upright position. The attachment means comprises an angle support and a pair of magnetic blocks permanently adhered to the interior walls of the angle support. The supporting means comprises a ring tangentially affixed to an exterior wall of the angle support.

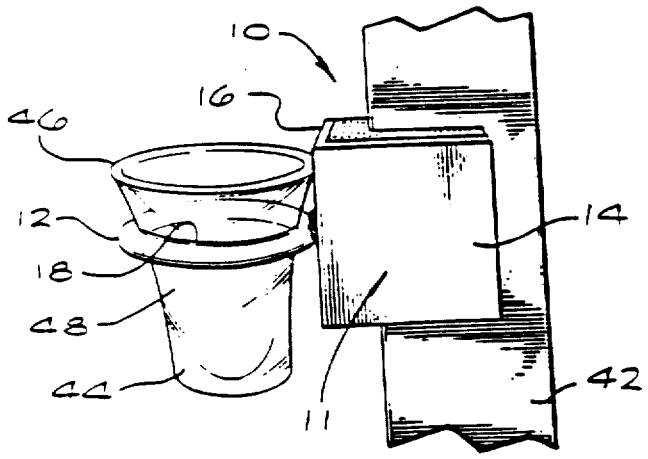

5 Claims, 2 Drawing Sheets